United States Patent [19]

Kella et al.

[11] 4,297,816

[45] Nov. 3, 1981

[54] INTERLOCKING CONSTRUCTION BLOCK

[76] Inventors: George Kella, 3205 Happy Valley, Jackson, Mich. 49203; Michael D. Kella, 7654 Carynway, Parma, Mich. 49269

[21] Appl. No.: 56,895

[22] Filed: Jul. 12, 1979

[51] Int. Cl.[3] ..... E04C 1/10; E04C 1/30

[52] U.S. Cl. ..... 52/125; 52/221; 52/293; 52/309.8; 52/506; 52/585; 52/594

[58] Field of Search ..... 52/125, 221, 293, 309.8, 52/309.12, 585, 594, 506

[56] References Cited

U.S. PATENT DOCUMENTS

| | | | |
|---|---|---|---|
| 1,567,430 | 12/1925 | Eberling | 52/125 |
| 1,630,698 | 5/1927 | Florey | 52/594 |
| 1,665,442 | 4/1928 | Campbell | 52/509 |
| 1,836,408 | 12/1931 | Sutton | 52/221 |
| 2,392,551 | 1/1946 | Roe | 52/586 |
| 2,668,435 | 2/1954 | Clements | 52/293 X |
| 2,933,920 | 4/1960 | Steuler | 52/586 X |
| 3,131,514 | 5/1964 | Siek | 52/309.8 |
| 3,391,507 | 7/1968 | Downing | 52/221 X |
| 3,478,482 | 11/1969 | Weir | 52/594 |
| 3,662,507 | 5/1972 | Espeland | 52/293 |

FOREIGN PATENT DOCUMENTS

| | | | |
|---|---|---|---|
| 528025 | 4/1954 | Belgium | 52/594 |
| 1159663 | 2/1958 | France | 52/585 |
| 603096 | 6/1948 | United Kingdom | 52/585 |
| 625552 | 6/1949 | United Kingdom | 52/585 |

*Primary Examiner*—Alfred C. Perham

*Attorney, Agent, or Firm*—Beaman & Beaman

[57] ABSTRACT

An interlocking construction block of thermally insulative material which is of a decorative nature and is capable of being erected without mortar. The block, which may be of construction block size, or of the dimensions of conventional brick, is molded of a synthetic insulative material and includes faces into which real brick inserts may be molded. The block upper wall includes a pair of truncated conical projections adapted to closely nest within conical recesses formed in the lower surfaces of the block above, and the blocks are provided with openings and finger grasping ledges to facilitate handling, and the end walls include elongated grooves for receiving interlocking pins. Fastener receiving recesses are defined between the projections, and the block includes voids at noncritical areas to reduce the mass. A foundation slab for use with the block of the invention is disclosed, as are caps when building walls.

1 Claim, 20 Drawing Figures

INTERLOCKING CONSTRUCTION BLOCK

BACKGROUND OF THE INVENTION

While a cement based mortar is commonly used in the erection of masonary block and brick walls, it is also known to assemble masonary wall components with adhesives or other non-masonary binders. Further, it is known to so construct the blocks or bricks that the same are capable of interconnection without a binder, and it is known to form interlocking projections and recesses on the wall elements to produce a mechanical interconnection which aids binding, or is in substitute thereof. Such interlocking features often include tapered or conical surfaces which nest in a close relationship to assure accurate orientation between adjacent blocks and bricks wherein an accurately constructed wall may be rapidly achieved with a minimum of skill and guide lines.

It is also known to form construction blocks and bricks of non-cement based material wherein a synthetic or composition material is employed which has a high thermal insulation factor, or provides other desirable physical characteristics such as reduction of weight, resistance to combustion, resistance to weathering, or facilitating wall assembly. Such blocks and bricks are usually formed in molds, and it is also known to impart such molded units with decorative patterns upon the exposed surfaces for aescetic purposes.

Construction blocks and bricks of the aforementioned type are illustrated in U.S. Pat. Nos. 990,119; 1,630,698; 2,911,818; 3,030,093; 3,305,982; 3,382,632 and 3,478,482.

Interlocking blocks of the type shown in the above patents have not enjoyed commercial success for various reasons, and it is an object of the invention to provide a decorative insulative construction brick or block which meets commercial requirements in all respects, and which constitutes an advance in the art.

BRIEF DESCRIPTION OF THE INVENTION

It is an object of the invention to provide an interlocking construction block or brick of thermal insulative material which may be readily and economically manufactured, is of high structural strength, and is of decorative appearance.

An additional object of the invention is to provide a structural block or brick which may be assembled with similar units to produce fluid tight seams and high structural strength is achieved with a minimum of binding material.

An additional object of the invention is to provide a construction block or brick utilizing interconnecting features wherein structural strength may be achieved with or without the use of a binder, and lock pins may be optionally employed to interlock adjacent units.

A further object of the invention is to provide a molded, thermally insulated block or brick of attractive appearance utilizing pattern faces, or inserts of decorative material, and employing interlocking features whereby very accurate assembly may be achieved and wherein blocks may be used to produce a brick-like appearance.

Further, an object of the invention is to produce a thermally insulated block or brick of synthetic material utilizing finger grasping means for facilitating handling, wherein the material resists combustion, and electrical fixtures may be incorporated into the block for permitting wiring.

Yet another object of the invention is to provide an interlocking construction block or brick incorporating fastener receiving means wherein nails, or the like, may be employed to attach the members to a wood wall or studding when the block or brick is being used as a veneer.

In the practice of the invention the construction member may take the form and dimension of a block, such as used in the construction of foundations, supporting walls, and the like, or the invention may be utilized in a smaller conventionally sized brick form as used for veneer purposes, fireplaces, decorative walls, etc. The members are formed of a synthetic material under pressure within molds, and the material, later described, is of a highly thermal insulative quality.

The construction members are formed with lateral faces, upper and lower surfaces, and end walls. The lateral faces may include a decorative pattern, or often include a thin real brick slab molded therein as to constitute an integral part of the block or brick. The upper surface is provided with a pair of annular, truncated, conical projections which are each in coaxial alignment with conical recesses intersecting the bottom surface. Thus, the projections of a lower member closely interfit with the recesses of the member supported thereon to produce an interlocking relationship providing a high resistance to horizontal shear forces.

Openings defined in the projections are of sufficient diameter to readily receive the assembler's fingers, and a finger engaging ledge is defined within these openings for facilitating handling. The upper surface is provided with a recess intermediate the projections forming a wall adjacent a lateral face through which a nail or other elongated fastener may be driven for affixing the member to a supporting wall or stud, and this recess also includes a locking pin receiving bore.

The end walls of the block or brick are preferably provided with elongated semi-cylindrical bores, which, together with a similar bore defined in the end wall of the adjacent block, form locking pin receiving bores wherein an additional interlocking can take place between adjacent units. Chambers for electric wires and plumbing exist within the blocks and bricks, and electrical fixtures may be molded into the blocks. Additionally, a foundation or base slab is disclosed which may be used with the blocks or bricks of the invention assuring interconnection thereof with the foundation, and this slab also utilizes a veneer ledge.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
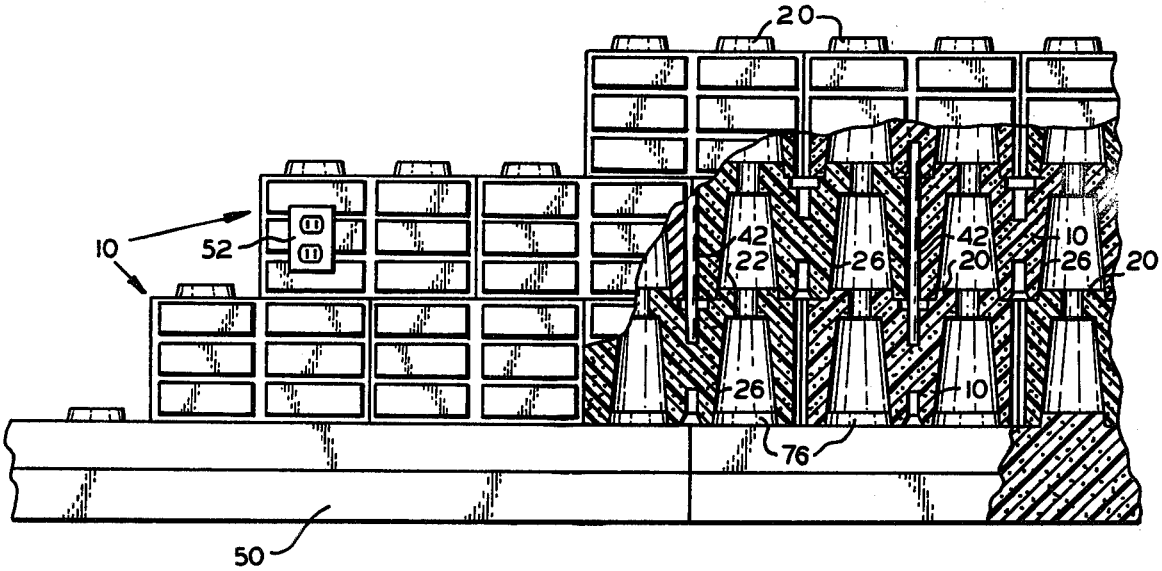
FIG. 1 is an elevational view, partially in section, illustrating a wall utilizing construction blocks in accord with the invention.
Figure 2:
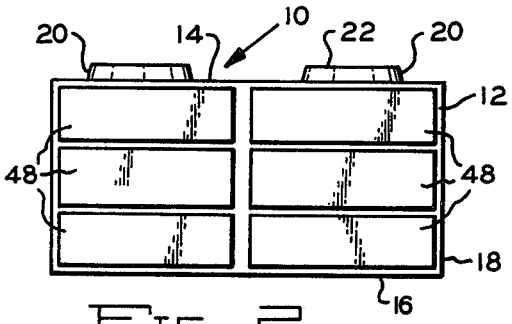
FIG. 2 is a side elevational view of the construction block employed in FIG. 1.
Figure 3:
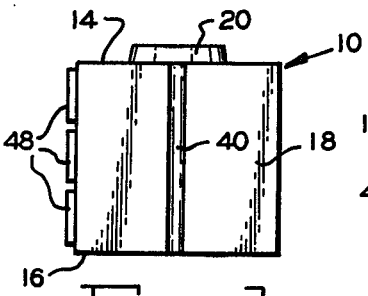
FIG. 3 is an end elevational view of the construction block.
Figure 5:
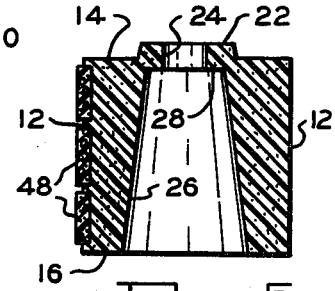
FIG. 5 is an elevational sectional view as taken along FIG. V—V of FIG. 4.

With reference to FIGS. 2-5 a construction block 10 utilizing concepts of the invention is shown. Such construction block is of a rectangular configuration having overall dimensions equal to that of a standard concrete block, and the block includes lateral faces 12, upper surface 14, a lower surface 16, and end walls 18 lying in a plane perpendicular to the planes of the faces 12 and upper and lower surfaces.

A pair of conical, truncated projections 20 extend upwardly from the upper surface 14, and these projections are equally spaced from the adjacent end wall 18. The projections include an outer conical surface, and are upwardly defined by the planar surface 22. A coaxial bore 24 is defined in the projections, for a purpose later described.

Figure 4:
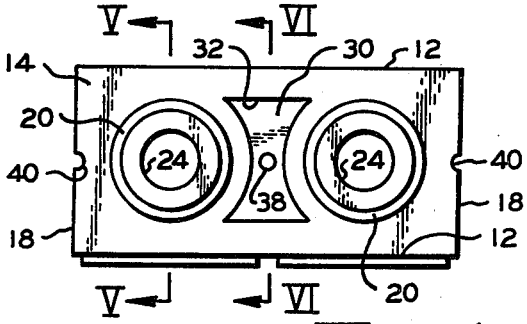
FIG. 4 is a top plan view of the construction block.

Internally, the block is provided with a pair of relatively large conical recesses 26, FIG. 4, which are coaxial with a projection 20 and the bore 24 thereof, and the recesses intersect the lower surface 16, and terminate in an upper wall 28 having a diameter greater than the bore 26 whereby a finger engaging ledge is defined by the walls 28 whereby the operator may insert a finger or fingers into a bore 24 to engage the ledge for facilitating handling of the block, and permitting the block to be handled and lifted by one hand, if desired. The diameter of the recesses 26 at the lower surface 16 is only slightly greater than the diameter of the projections 20 adjacent the upper surface 14, and the conical angles are equal, whereby the stacking of the blocks in accord with the invention permits the projections of the lower blocks to be closely received within the recesses of the blocks immediately thereabove, as will be appreciated from FIG. 1. Such an interlocking connection establishes high strength mechanical interconnection between adjacent blocks, even without mortar.

Figure 6:
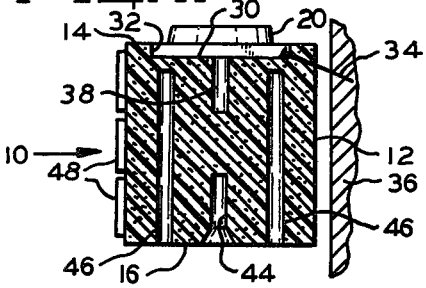
FIG. 6 is an elevational sectional view as taken along Section VI—VI of FIG. 4.

An hour glass shaped recess 30 is defined in the upper surface 14, FIGS. 4 and 6, and this recess includes side walls 32 parallel to and spaced from an associated block face 12. The purpose of the walls 32 is to permit a fastener, such as a nail 34, FIG. 6, to be driven through the wall for attaching the block to an adjacent stud or wall 36 when the block is being used as a veneer, or it is desirous to otherwise support the wall. The recess 30 also includes a centrally located blind bore 38, FIG. 6, for receiving locking pins, as later described.

The end walls 18 are each provided with an elongated semi-cylindrical groove 40 which intersects the upper and lower surfaces 14 and 16, and is centrally located between the faces 12. Thus, when the blocks are assembled a locking pin 42 may be inserted in the defined cylindrical bores formed by grooves 40, the upper end of the pin being located within a centrally located bore 44 intersecting the block lower surface, FIG. 6, and the lower end being located within a bore 38. Voids 46, FIG. 6, may be defined in the block for reducing the amount of material required, without sacrificing necessary strength.

As the blocks 10 are formed of a composition material by molding procedures, if desired, a face 12, or both faces 12, may be provided with a decorative pattern formed therein by the mold. In many cases, the decorative material located upon one or both of the block faces will take the form of the real brick inserts 48 which are molded into the block material and extend inwardly of the faces 12, as will be appreciated from FIG. 5. The brick inserts are of a dimension equal to conventional bricks, and six may be located upon a block face as apparent in FIGS. 1 and 2. Accordingly, when the blocks are assembled as shown in FIG. 1 the resulting wall will have the appearance of brick work, rather than a block construction.

As will be appreciated from FIG. 1, a block wall in accord with the invention is mounted upon a foundation slab generally indicated at 50, and later described with respect to FIGS. 17 and 18. In the illustrated arrangement adjacent rows are staggered in that the end walls of one course are in line with the center of the course above offsetting joint lines, and permitting use of locking pins 42 in the manner illustrated. If the wall is assembled wherein vertically extending end walls 18 are aligned locking pins of a length equal to the wall height could be used, if desired.

In assembling a wall utilizing the aforedescribed blocks conventional mortar is not employed, but a construction adhesive or glue may be utilized which is compatible to the material of the blocks. The adhesive used should be of a relatively light mass and density so as not to interfere with the mechanical interconnection achieved between the projections 20 and associated recesses 25, and in some applications the use of an adhesive may be entirely omitted. In such instance the use of the locking pins 42 is also optional, and it is possible to employ locking pins without an adhesive.

The molded construction of the blocks assures that the upper and lower surfaces, and end walls, are of a flat configuration wherein only a minimum of adhesive is required to render the wall waterproof, and the self-alignment of the blocks due to the interlocking achieved by the projections and recesses permits a very accurate wall to be erected with a minimum of skill eliminating the usual guides and plumb lines.

Figure 7:
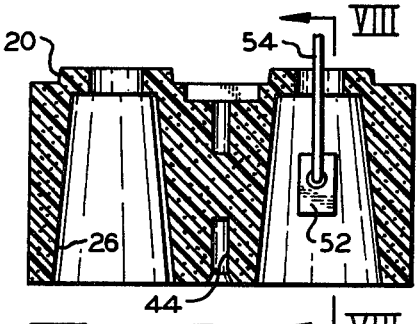
FIG. 7 is an elevational sectional view as taken through the center of a modification of block similar to FIG. 2, illustrating an electrical box and conduit located therein.
Figure 8:
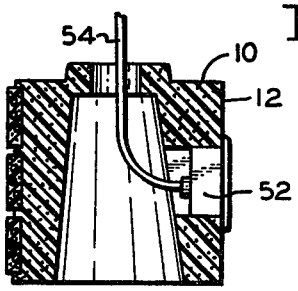
FIG. 8 is a sectional view taken along Section VIII—VIII of FIG. 7.

FIGS. 7 and 8 illustrate a block 10 similar to that previously described in all respects except that an electrical box 52 is molded into the block for access at a face 12. The box 52 may contain a double outlet as shown in FIG. 1, or constitute the housing for a switch, television aerial, or other electrical fixture. The cable or conduit 54 supplying the box extends into the associated recess 26, and upwardly through the bores 24 and recesses of blocks located thereabove, and the presence of the bores and recesses readily permits electrical wiring and plumbing conduits to be inserted into a wall constructed of blocks of the invention.

FIGS. 9–13 illustrate the concepts of the invention utilized in a brick construction member 56 of the size of a conventional brick, and components similar to those previously described with respect to the construction block 10 are indicated by identical primed reference numerals. Of course, with the brick embodiment only a single brick insert 48′ is embedded into a lateral face of the brick, and it will be noted that the bores 24′ may have walls of a conical configuration. Bricks 56 are assembled to each other to form a wall in the same manner as the blocks shown in FIG. 1.

Figure 14:
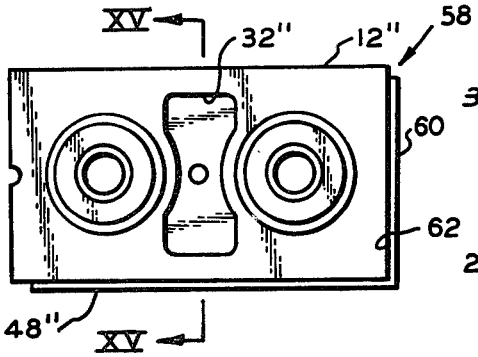
FIG. 14 is a top plan view of a brick incorporating the concepts of the invention having a molded brick insert extending along both the side face and end wall.
Figure 15:
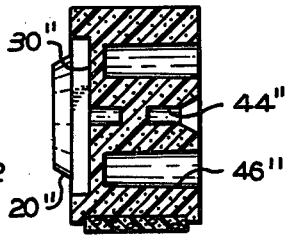
FIG. 15 is an elevational sectional view as taken along Section XV—XV of FIG. 14.

The brick 58 shown in FIGS. 14 and 15 is identical to that shown in FIGS. 9–13 in all respects except that this brick constitutes a corner brick having a brick slab portion insert 60 molded into the end wall 62 whereby the brick may be used at the corner of a wall to produce the desired appearance. FIG. 15 is a central sectional view taken through the brick 58, whose components identical to those previously described are indicated by double primes, and the cross sectional view shown in FIG. 15 is identical to that similar sectional view if taken through the brick shown in FIGS. 9–13.

Figure 9:
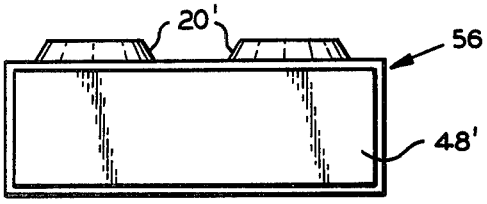
FIG. 9 is a side elevational view of a brick incorporating the concepts of the invention.
Figure 10:
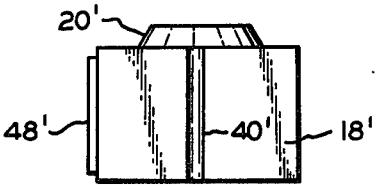
FIG. 10 is an end elevational view as taken from the right of FIG. 9.
Figure 12:
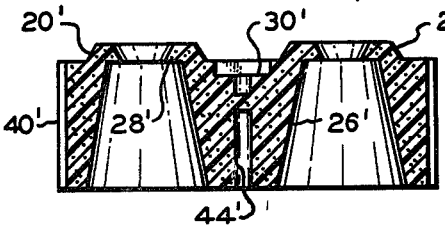
FIG. 12 is an elevational sectional view as taken along Section XII—XII of FIG. 11.
Figure 11:
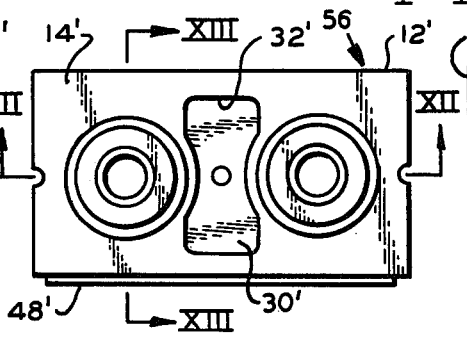
FIG. 11 is a top plan view of the brick of FIG. 9.
Figure 13:
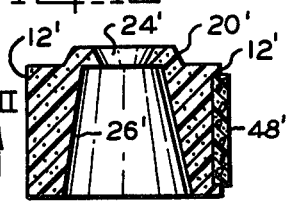
FIG. 13 is an elevational sectional view as taken along Section XIII—XIII of FIG. 11.
Figure 16:
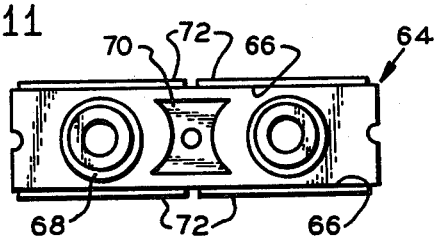
FIG. 16 is a top plan view of a brick constructed in accord with the invention having inserts molded upon both side faces.

FIG. 16 illustrates an embodiment of brick 64 constructed in a manner similar to that previously described wherein the brick includes lateral faces 66, projections 68, and a recess 70 located in the upper surface. A pair of real brick inserts 72 are molded into each face of the brick wherein a decorative appearance is achieved which appears that only the ends of bricks are visible, and this type of brick may be incorporated into a wall utilizing bricks such as shown in FIG. 9 to vary the wall appearance.

Figure 17:
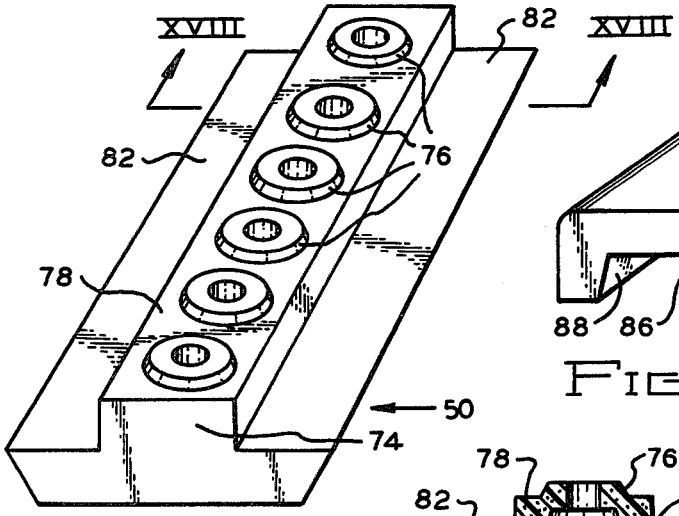
FIG. 17 is a perspective view of a foundation slab constructed in accord with the invention.
Figure 18:
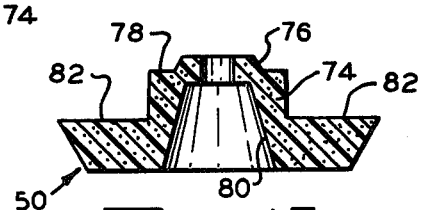
FIG. 18 is an elevational sectional view taken along Section XVIII—XVIII of FIG. 17.

FIGS. 17 and 18 illustrate a foundation slab 50 which may be used in conjunction with the block or brick of the invention. The slab constitutes a mass, either of concrete, or composition material similar to that of which the blocks and brick are formed. The slab 50 includes a central portion 74 having a plurality of truncated conical projections 76 extending therefrom similar to those formed upon the upper surfaces of the previously described blocks and bricks. Thus, upon placing blocks or bricks upon the slab surface 78 the same will be accurately oriented to the slab due to the reception of the projections 76 into the conical recesses 26 of the block or brick. Recesses 80 may be formed in the slab, FIG. 18, to minimize the material required in the slab, and the slab includes horizontal surfaces 82 located on each side of the central slab portion 74 constituting ledges upon which brick may be layed, or other veneer placed. For instance, it may be desired to lay blocks upon the surface 78 and build a veneer wall of bricks in accord with the invention as supported upon a ledge 82.

Figure 19:
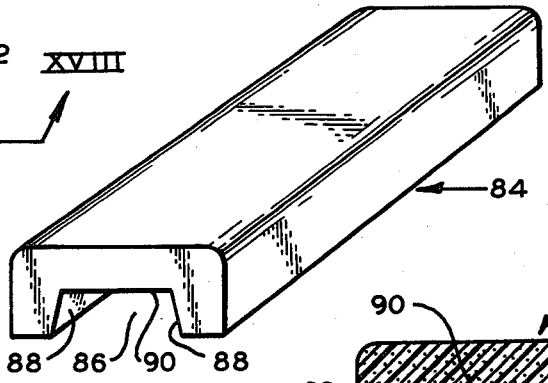
FIG. 19 is a perspective view of a cover cap as used with construction members in accord with the invention.
Figure 20:
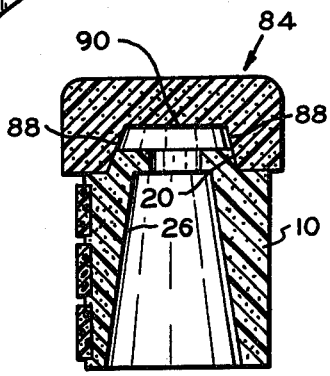
FIG. 20 is an elevational sectional view illustrating the cap as mounted upon a construction block formed in accord with the invention.

When forming a wall of the blocks or bricks described the upper course may be covered by cap members 84 as shown in FIGS. 19 and 20. Such caps include an elongated mass having a recess 86 defined in the lower surface thereof including tapered flat surfaces 88, and a flat surface 90. The dimension separating the surfaces 88 substantially equals the diameter of the projections 26 whereby the cap may rest upon the upper surface of block or brick, as will be apparent from FIG. 20. In this manner the upper surface of block or brick is entirely shielded from view, water and foreign matter cannot enter the units, and the cap provides a uniform aesthetically pleasing appearance.

It is desired that the blocks and bricks of the invention be formed by a molding process and of a composition which is readily moldable, provides excellent thermal insulative characteristics, and is of a high mechanical strength. Such a material must be of a relatively high density, fire and water resistant, capable of being accurately formed, and have the ability to maintain the molded dimensions. Preferably, the blocks and bricks are formed of a composition having the following ingredients measured in mililiters:

| | MEASURED IN MILILITERS |
|---|---|
| Isocyante Repolymer | 121 |
| Resin R-0634 | 128 |
| Glass Beads S-080 | 206 |
| Microspheres M-004 | 131 |
| Peastone F-375 | 301 |
| Polyol Paste C-21 | 76 |
| Polyurethane Bearer Coat on Face | 28 |
| Silicone mixed with Metylene Chloride | 20 |
| Fire Retardant | 75 |

The blocks and bricks are preferably formed by injecting the silicone and metylene chloride mixture into the mold during the initial stage. The isocyante Repolymer and resin R-0634 is mixed together in the first stage. Glass beads S-080, microspheres M-004, the washed peastones F-375 and the polyol paste C-21, which is used to provide a brick color, are mixed together in a second stage. The first stage mixing head blends with the second stage mixing head which injects the mixture into the mold. Immediately, the polyurethane bearer coat is injected into the mold, and the mold is heated to 90° F. and five minutes are allowed for curing time. The construction member is then ready for ejection from the mold and cooling.

Bricks constructed in accord with the invention may be installed in 7 to 10 seconds each as compared with a considerably slower rate when conventional bricks and mortar systems are used. Fluid tight seals may be readily achieved, and settling cracks and wall distortion are eliminated. An attractive finished wall may be achieved without secondary operations, and excellent thermal insulative quality exists. The preferred composition shows little deterioration over long periods of time, and the interlocking features of the invention minimize the skill required to lay a precision wall. Accordingly, it will be appreciated that the objects of the invention have been achieved by the disclosed embodiments.

It is understood that various modifications to the inventive concepts may be apparent to those skilled in the art without departing from the spirit and scope of the invention.

We claim:

1. A thermally insulated interlocking construction block of rectangular configuration having lateral faces, ends, an upper side and a lower side, a pair of tapered projections defined on said upper side extending therefrom each having an axis and a wall surface converging in a direction away from said upper side, said projections each having a diametrical base dimension adjacent said upper side, a pair of tapered recesses each having an axis defined in said block intersecting said lower side, the axes of a projection and recess being coincident, said recesses each including a tapered wall surface at the intersection with said lower surface having a maximum diametrical dimension at said intersection slightly greater than said projection base dimension for nesting with the projection of a similar block, said recesses' wall surface tapering toward the coincident projection and axially aligned therewith terminating in an upper wall transversely disposed to the associated recess axis and in close proximity to said block upper side, an opening defined in each projection intersecting the associated recess upper wall and of a diameter less than that of the associated recess upper wall and large enough to receive a finger whereby said upper walls defines a finger grippable ledge when a finger is inserted through an opening, said projections and recesses being spaced from each other in the direction of the length of said block and equally spaced on opposite sides of a plane extending through the midpoint of the block perpendicular to the block's length, an elongated semi-cylindrical groove defined in each end of said block intersecting said upper and lower sides and having an axis lying within the plane parallel to said block faces and equidistant therebetween whereby the grooves of contiguous blocks define a locking pin receiving bore, a pin receiving bore defined in said block's upper side equidistant between said faces and ends of the associated block, a blind recess defined in said block upper side intermediate said lateral faces and projections defining a vertical wall adjacent each face inwardly spaced from the adjacent face and substantially parallel thereto whereby a fastener may be inserted through a recess wall to attach said block to support structure, said pin receiving bore intersecting said blind recess.

* * * * *